US012227344B2

(12) United States Patent
Morciano et al.

(10) Patent No.: US 12,227,344 B2
(45) Date of Patent: Feb. 18, 2025

(54) SPOUT FOR A PACKAGE, LID-SPOUT ASSEMBLY FOR A PACKAGE AND PACKAGE HAVING A SPOUT

(71) Applicant: TETRA LAVAL HOLDINGS & FINANCE S.A., Pully (CH)

(72) Inventors: Davide Morciano, Modena (IT); Pietro Martini, Parma (IT); Rocco De Paola, Modena (IT); Paolo Zanon, Modena (IT); Ivan Orlandi, Savignano sul Panaro (IT); Anna Rosa Vietri, Modena (IT); Cristian Costarelli, Ancona (IT); Davide Corradi, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 17/913,943

(22) PCT Filed: Apr. 1, 2021

(86) PCT No.: PCT/EP2021/058625
§ 371 (c)(1),
(2) Date: Sep. 23, 2022

(87) PCT Pub. No.: WO2021/204675
PCT Pub. Date: Oct. 14, 2021

(65) Prior Publication Data

US 2023/0127158 A1 Apr. 27, 2023

(30) Foreign Application Priority Data

Apr. 9, 2020 (EP) ..... 20168906

(51) Int. Cl.
*B65D 47/10* (2006.01)
*B65D 5/74* (2006.01)
(Continued)

(52) U.S. Cl.
CPC ..... *B65D 5/746* (2013.01); *B65D 47/0876* (2013.01); *B65D 47/103* (2013.01);
(Continued)

(58) Field of Classification Search
CPC ..... B69L 2031/565; B69L 2031/7166; B65D 2251/0025; B65D 2251/0093;
(Continued)

(56) References Cited

U.S. PATENT DOCUMENTS 1,836,811 A * 12/1931 Mcneal ..... B65D 35/42 220/291
4,948,015 A * 8/1990 Kawajiri ..... B65D 5/749 222/541.9
(Continued)

FOREIGN PATENT DOCUMENTS

EP 2949595 A1 12/2015
FR 2903968 A1 1/2008
(Continued)

OTHER PUBLICATIONS

International Search Report (PCT/ISA/210) and Written Opinion (PCT/ISA/237) mailed on Jun. 1, 2021, by the European Patent Office as the International Searching Authority for International Application No. PCT/EP2021/058625. (10 pages).
(Continued)

*Primary Examiner* — Charles P. Cheyney
(74) *Attorney, Agent, or Firm* — BUCHANAN INGERSOLL & ROONEY PC

(57) ABSTRACT

There is described a spout for a package having a designated pour opening and being filled with a pourable product. The spout comprises at least a collar extending along a longitudinal axis, carrying a pouring outlet at a first axial end and an inlet opening for the pourable product at a second axial end and delimiting a flow channel for the pourable product
(Continued)

extending between the pouring outlet and the inlet opening a closing element configured to interrupt a fluidic connection between the pouring outlet and the inlet opening. The closing element is interposed between the inlet opening and the pouring outlet and is rupturably fixed to an inner surface of the collar.

14 Claims, 7 Drawing Sheets

(51) Int. Cl.
*B65D 47/08* (2006.01)
*B65D 51/22* (2006.01)

(52) U.S. Cl.
CPC .... *B65D 51/228* (2013.01); *B65D 2251/0025* (2013.01); *B65D 2251/0093* (2013.01)

(58) Field of Classification Search
CPC ..... B65D 2251/0015; B65D 2251/023; B65D 51/228; B65D 51/20; B65D 47/103; B65D 47/0875; B65D 47/123; B65D 5/746; B65D 5/747; B65D 5/749
USPC ..... 220/270, 258.2; 222/541.9
See application file for complete search history.

(56) References Cited

U.S. PATENT DOCUMENTS 5,054,642 A * 10/1991 Yoshida ..... B65D 17/508 220/276
5,108,029 A * 4/1992 Abrams ..... B65D 5/746 220/837
5,133,470 A * 7/1992 Abrams ..... B29C 66/549 215/250
5,199,635 A * 4/1993 Abrams ..... B65D 5/746 229/125.09
5,725,121 A * 3/1998 Gianpaolo ..... B65D 5/746 220/784
6,179,147 B1 * 1/2001 Mogard ..... B65D 47/103 222/541.9
6,302,286 B1 * 10/2001 Witherspoon ..... A61J 11/008 215/11.1
6,622,882 B2 * 9/2003 Smith ..... B65D 47/0842 215/253
6,910,594 B2 * 6/2005 Foley ..... A61J 9/001 215/11.1
7,472,797 B2 * 1/2009 Ostrowski ..... A61J 9/085 220/792
D676,318 S * 2/2013 MacNeill ..... D9/446
8,631,966 B2 * 1/2014 Pirner ..... B01L 3/50825 215/354
10,293,972 B2 * 5/2019 Golfieri ..... B65D 5/747
10,414,551 B2 * 9/2019 Martini ..... B65D 41/0485
2005/0023238 A1 * 2/2005 Wong ..... B65D 55/16 220/291
2009/0308834 A1 * 12/2009 Isogai ..... B65D 47/0838 215/329
2010/0166923 A1 * 7/2010 Martini ..... B65D 5/747 426/115
2012/0024815 A1 2/2012 Kwon
2012/0228339 A1 * 9/2012 Kaneko ..... B65B 3/02 222/566
2015/0353247 A1 * 12/2015 Isogai ..... B65D 47/106 215/252
2016/0288961 A1 10/2016 Maguire
2016/0325471 A1 * 11/2016 Martini ..... B29C 43/34
2019/0344540 A1 * 11/2019 Cavanna ..... B29C 66/61

FOREIGN PATENT DOCUMENTS

JP H07315374 A 12/1995
JP 2011-500461 A 1/2011
JP 2013107673 A 6/2013
JP 2018172136 A 11/2018
JP 2019-214421 A 12/2019

OTHER PUBLICATIONS

U.S. Appl. No. 17/913,918, filed Sep. 23, 2022, Davide Morciano et al.
U.S. Appl. No. 17/914,059, filed Sep. 23, 2022, Davide Morciano et al.
U.S. Appl. No. 17/907,170, filed Sep. 23, 2022, Stefano Menozzi et al.
U.S. Appl. No. 17/914,025, filed Sep. 23, 2022, Davide Morciano et al.
U.S. Appl. No. 17/914,119, filed Sep. 23, 2022, Paolo Zanon et al.
Office Action (Communication pursuant to Article 94(3) EPC) issued on May 2, 2024, in corresponding European Patent Application No. 21166551.8. (5 pages).

* cited by examiner

SPOUT FOR A PACKAGE, LID-SPOUT ASSEMBLY FOR A PACKAGE AND PACKAGE HAVING A SPOUT

TECHNICAL FIELD

The present invention relates to a spout for a package, in particular a package having a sealed main body, filled with a pourable product, even more particular filled with a pourable food product.

Advantageously, the present invention relates to a lid spout assembly for a package, in particular a package having a sealed main body, filled with a pourable product, even more particular filled with a pourable food product.

Advantageously, the present invention also relates to a package, in particular a package having a sealed main body, filled with a pourable product, even more particular filled with a pourable food product, and comprising a spout.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages, in particular respective sealed main bodies of the packages formed from the packaging material, comprise a designated pour opening, which allows the outpouring of the pourable product from the packages. Typically, the designated pour opening is covered by a separation membrane, which isolates the inside of the package from the outer environment and which is to be opened or to be removed or to be ruptured or to be cut or to be pierced prior to the first outpouring of the pourable product so as to allow for the outpouring of the pourable product through the designated pour opening. It is also known to arrange a lid-spout assembly having a spout and a lid on the main body about the designated pour opening. The spout has a pouring outlet so as to allow for a controlled outpouring of the pourable product from the package and the lid allows to selectively close and open the pouring outlet.

The spout comprises a collar, which carries the pouring outlet at a first axial end and an inlet opening arranged at a second axial end. After the loss of integrity of the separation membrane it is possible with the lid being removed from the spout to pour the pourable product from the inner space of the package out of the pouring outlet. The pourable product flows from the inner space of the package through the inlet opening to the pouring outlet. Once the lid is arranged on the spout again, the lid impedes the outflow of the pourable product from the pouring outlet, however, the pourable product can, in dependence of the orientation of the package, still flow into a flow channel extending between the inlet opening and the pouring outlet of the collar.

There is known one type of lid-spout assembly, which is designed such to also block the possibility of the pourable product entering the flow channel with the lid closing the pouring outlet. Such a lid-spout assembly is provided with a spout, which comprises a closing element coupled by means of a coupling member to the lid. Such a closing element is fused to the separation membrane and/or at least partially defines the separation membrane and is positioned such to seal the inlet opening. In particular, the closing element is configured such to contact a rim portion of the collar delimiting the inlet opening.

Typically, such a spout also comprises a coupling membrane connecting the closing element to the rim portion and which ruptures the first time the lid is removed from the spout.

It is known to form such packages in automatic packaging machines starting from a substantially flat packaging material carrying the spout, which is folded, filled with the pourable product and sealed. In more detail, the applicant applies a technology, which is based on the packaging material being provided in the form of an endless web, which is advanced within the automatic packaging machine. During the advancement, the spouts are applied on the packaging material by molding, in particular injection molding. Then, the web is folded into a tube, longitudinally sealed, filled with the pourable product and transversally sealed and cut for obtaining the single packages. Finally, the lids are applied onto the respective spouts.

It has been observed that during the formation, the spout is subjected to forces, which may lead to deformations of the spout.

It has also been found that the presence of the coupling member leads to a possible deformation of the closing element and a loss in the precision of the positioning of the closing element within the spout.

Thus, the need is felt in the sector to improve such spouts in order to overcome the encountered inconveniences.

DISCLOSURE OF INVENTION

It is therefore an object of the present invention to provide in a straightforward and low-cost manner an improved spout for a package, in particular a package having a sealed main body, filled with a pourable product, even more particular filled with a pourable food product.

In particular, it is an object of the present invention to provide in a straightforward and low-cost manner an improved spout for a package, in particular a package having a sealed main body, filled with a pourable product, even more particular filled with a pourable food product, which comes along with an increased stability of the spout and/or for allowing for a more precise positioning of a closing element of the spout.

It is another object of the present invention to provide in a straightforward and low-cost manner an improved lid-spout assembly for a package, in particular a package having a sealed main body, filled with a pourable product, even more particular filled with a pourable food product.

In particular, it is an object of the present invention to provide in a straightforward and low-cost manner an improved lid-spout assembly for a package, in particular a package having a sealed main body, filled with a pourable product, even more particular filled with a pourable food product, which comes along with an increased stability of the lid-spout assemblies and/or for allowing for a more precise positioning of a closing element of the spout.

It is a further object of the present invention to provide in a straightforward and low-cost manner a package, in particular a package having a sealed main body, filled with a pourable product, in particular filled with a pourable food product, having a spout, in particular the spout being designed to come along with an increased stability of the spout and/or to allow for a more precise positioning of a closing element of the spout.

BRIEF DESCRIPTION OF THE DRAWINGS

Three non-limiting embodiments of the present invention will be described by way of example with reference to the accompanying drawings, in which.

BEST MODES FOR CARRYING OUT THE INVENTION

Figure 1:
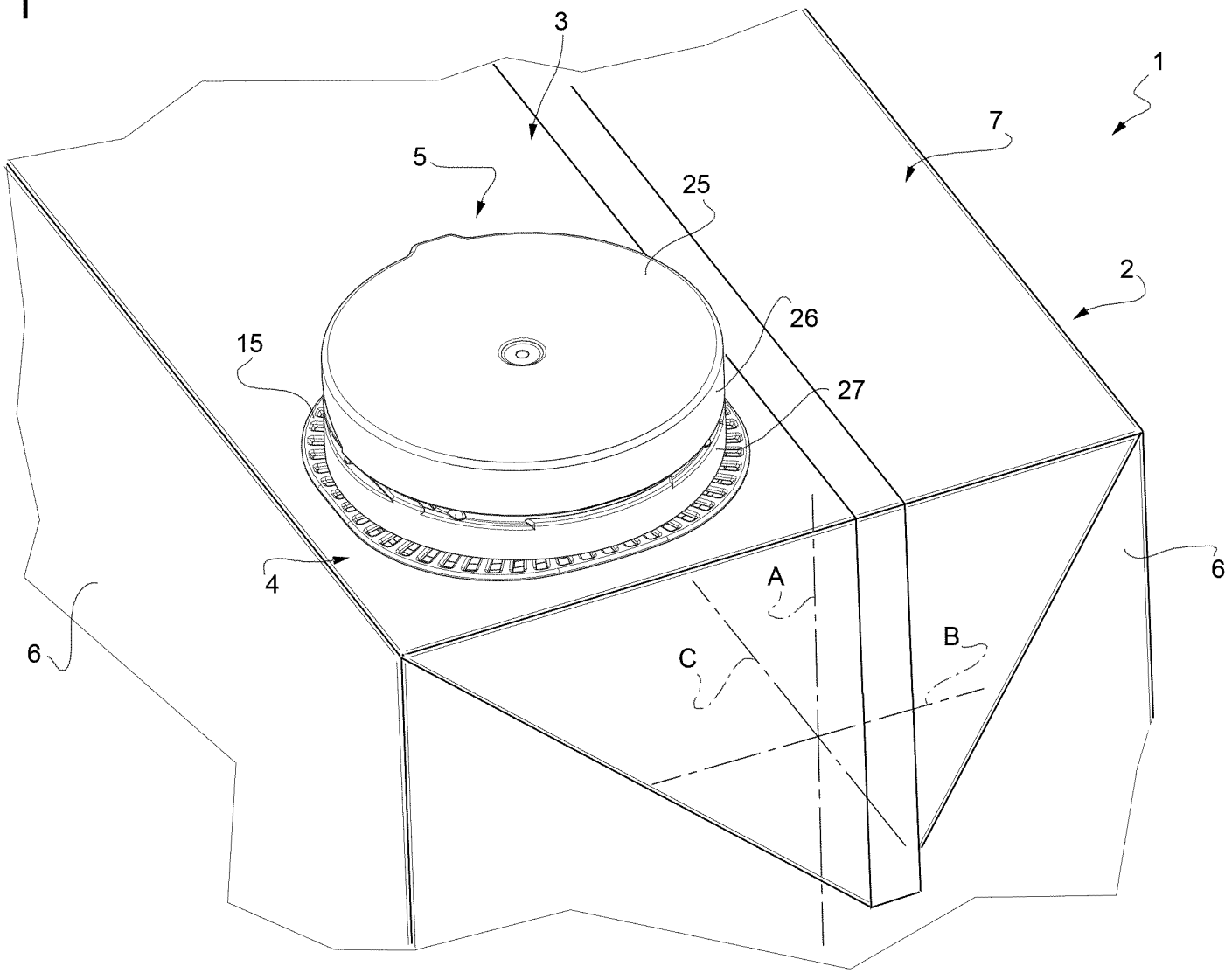
FIG. 1 is a schematic perspective view of a portion of a package having a spout according to a first embodiment of the present invention coupled to a respective lid, with parts removed for clarity.
Figure 2:
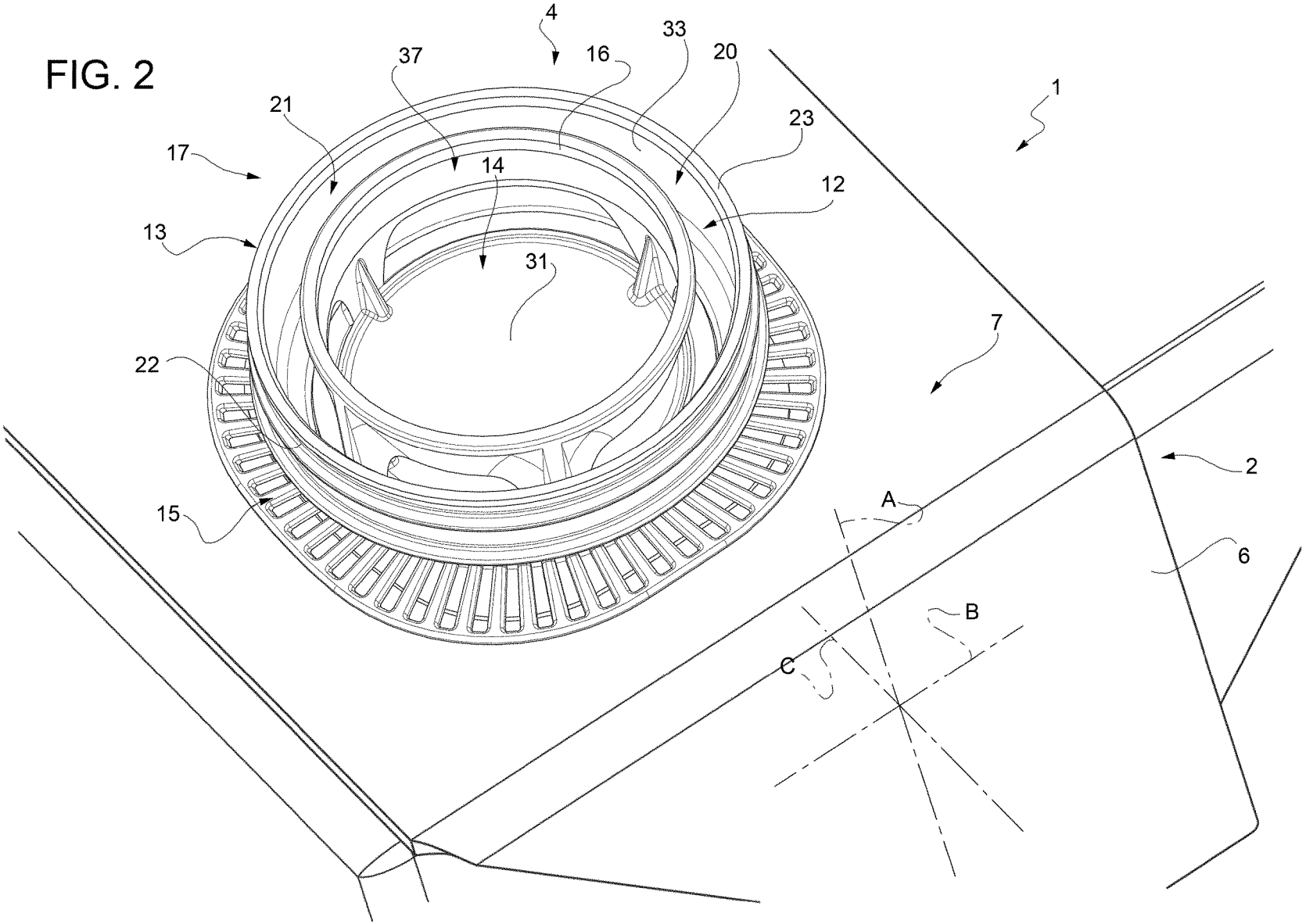
FIG. 2 is an enlarged top view of a portion of the package of FIG. 1, with parts removed for clarity.

Number 1 indicates as a whole a package (only partially shown to the extent necessary for the comprehension of the present invention) comprising:

- a sealed main body 2, in particular a sealed carton main body, being filled with a pourable product, in particular a pourable food product, and in particular having a designated pour opening (not shown and known as such) configured to allow for an outflow of the pourable product from main body 2; and
- a lid-spout assembly 3 coupled to the sealed main body 2 and having at least a spout 4 arranged and/or arrangeable about the designated pour opening and a lid 5 coupled and/or couplable to spout 4.

According to some preferred non-limiting embodiments, main body 2 is obtained from a packaging material, in particular a composite packaging material, having a multilayer structure (not shown and known as such).

Preferentially, the packaging material is provided in the form of a web.

Preferentially, main body 2 is obtained by forming a tube from the packaging material, longitudinally sealing the tube, filling the tube with the pourable product and by transversally sealing and cutting the tube.

Preferentially, the packaging material comprises at least a layer of fibrous material, such as e.g. paper or cardboard, and at least two layers of heat-seal plastic material, e.g. polyethylene, interposing the layer of fibrous material in between one another. One of these two layers of heat-seal plastic material defining the inner face of main body 2 contacting the pourable product.

Preferably, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, the packaging material also comprises a further layer of heat-seal plastic material being interposed between the layer of gas- and light-barrier material and the layer of fibrous material.

According to a preferred non-limiting embodiment, spout(s) 4 is (are) applied to base package(s) 2 prior, during or after the formation, filling and sealing of main body(ies) 2.

Alternatively, spout(s) 4 can be applied onto the packaging material prior to arranging the packaging material within or during advancement of the packaging material through a packaging machine for forming, filling and sealing main bodies 2 from the packaging material.

In particular, application of spout(s) 4 to the packaging material or to main body 2 occurs by means of a molding process and/or adhesive bonding and/or ultrasonic bonding.

Preferentially, lid 5 is coupled to spout 4 prior or after application of spout 4 onto main body 2 or onto the packaging material.

With particular reference to FIG. 1, main body 2 extends along a longitudinal axis A, a first transversal axis B and a second transversal axis C. In particular, the extension of package 2 along longitudinal axis A is larger than the extension of package 2 along first transversal axis B and second transversal axis C.

Preferentially, main body 2 is parallelepiped-shaped.

According to some preferred non-limiting embodiments, main body 2 comprises a first wall portion (not shown and known as such), in particular being transversal, even more particular perpendicular, to longitudinal axis A, from which main body 2 extends along longitudinal axis A. Preferably, the first wall portion defines a support surface of package 1, in particular main body 2, which is designed to be put in contact with a support, such as e.g. a shelf, when, in use, being e.g. exposed within a sales point or when being stored. In particular, when being arranged on a support the first wall portion defines a bottom wall portion.

Preferably, main body 2 also comprises a plurality of lateral walls 6 being (fixedly) connected to the first wall portion and extending, in particular substantially parallel to longitudinal axis A, from the first wall portion.

Preferably, main body 2 also comprises a second wall portion 7 opposite to the first wall portion and being (fixedly) connected to at least some of lateral walls 6. In particular, lateral walls 6 are interposed between the first wall portion and second wall portion 7. In particular, when being arranged on a support, second wall portion 7 defines a top wall portion.

According to some non-limiting embodiments, the first wall portion and second wall portion 7 may be parallel to one another.

According to a non-limiting alternative embodiment not shown, the first wall portion and second wall portion 7 could be inclined with respect to one another.

According to some non-limiting embodiments, second wall portion 7 carries and/or comprises the designated pour opening.

According to some preferred non-limiting embodiments, package 1, in particular main body 2, comprises an inner space 8 configured to contain and/or containing the pourable product. In particular, the first wall portion, lateral walls 6 and second wall portion 7 delimit inner space 8.

According to a preferred non-limiting embodiment, main body 2 comprises a separation membrane (not shown and known as such) covering the designated pour opening. In particular, the separation membrane separates in the area of, in particular at, the designated pour opening inner space 8 from the outer environment. Preferentially, the separation membrane comprises a gas- and light-barrier material, e.g. aluminum foil or ethylene vinyl alcohol (EVOH) film.

In particular, during the first-time use (see further below for more details), the separation membrane is at least partially removed for allowing the pourable product to flow out of inner space 8 and main body 2.

According to a preferred non-limiting embodiment, the separation membrane is defined by a portion of the packaging material, in particular a portion of the layers of the packaging material being different from the layer of fibrous material.

Alternatively, the separation membrane could be partially or fully defined by other portions of package 1.

According to some preferred non-limiting embodiments, main body 2, in particular second wall portion 7, comprises a respective inner surface 9 facing inner space 8 and a respective outer surface 10 opposite to inner surface 9. In particular, inner surface 9 is in contact with the pourable product.

With particular reference to FIGS. 1 to 6, spout 4 comprises at least:

- a pouring outlet 12 configured to allow for the outflow of the pourable product from package 1; and
- a collar 13 carrying (comprising) pouring outlet 12; and
- a closing element 14 configured to selectively control a fluidic connection of pouring outlet 12 with inner space 8, and in particular being operatively coupled to lid 5.

Preferentially, spout 4 also comprises a base frame 15 coupling and/or configured to couple spout 4 to main body 2, in particular to second wall portion 7, about the designated pour opening.

Preferentially, spout 4 also comprises one or more coupling members 16 connected to closing element 14 and lid 5 and configured to operatively connect closing element 14 and lid 5 to one another. In particular, coupling members 16 are configured to couple lid 5 and closing element 14 in such a manner that any movement of lid 5 results in a concurrent movement of closing element 14. Even more particular, coupling members 16 are inseparably connected (under normal working conditions) to lid 5 and closing element 14.

According to some preferred non-limiting embodiments, spout 4, in particular collar 13 and closing element 14, preferentially also base frame 15 and coupling members 16, is/are formed and/or molded from a polymer.

Preferentially, also lid 5 is formed and/or molded from a polymer.

According to some preferred non-limiting embodiments, coupling members 16 are fused and/or welded and/or bond and/or molded to lid 5, in particular after application of lid 5 to spout 4.

In more detail, collar 13 extends along a central axis E, in particular parallel to longitudinal axis A, and carries (comprises) pouring outlet 12 at a first axial end 17 of collar 13 itself and an inlet opening 18 for the pourable product at a second axial end 19 of collar 13 itself opposite to first axial end 17. In particular, collar 13 delimits (and/or comprises) a flow channel 20 for the pourable product extending between inlet opening 18 and pouring outlet 12. In use, collar 13 is configured such to receive the pourable product from inner space 8 through inlet opening 18 and such that the pourable product flows out of pouring outlet 12.

Advantageously, closing element 14 is configured to control a fluidic connection between pouring outlet 12 and inlet opening 18, in particular for controlling the fluidic connection between pouring outlet 12 and inner space 8.

Preferentially, pouring outlet 12 and inlet opening 18 extend within respectively a first plane H1 and a second plane H2 being axially displaced from first plane H1 with respect to central axis E. In particular, first plane H1 and second plane H2 are perpendicular to central axis E.

Preferentially, collar 13 comprises an inner surface 21, in particular delimiting flow channel 20.

Even more preferentially, collar 13 also comprises an outer surface 22 opposite to inner surface 21.

Preferentially, collar 13 comprises a first rim 23 arranged at first axial end 17 and delimiting pouring outlet 12 and a second rim 24 arranged at second axial end 18 and delimiting inlet opening 18.

In particular, collar 13 has a tubular configuration.

Even more particular, collar 13 has an annular cross-sectional profile with respect to a cross-sectional plane perpendicular to central axis E.

In particular, collar 13 is or is controllable in fluidic connection with the designated pour opening and/or at least partially extends through the designated pour opening and into inner space 8.

In more detail, closing element 14 is operatively coupled to lid 5, in particular by means of coupling members 16, and is arranged and/or is arrangeable within flow channel 18. In particular, closing element 14 is configured to selectively control a fluidic connection between inlet opening 18 and pouring outlet 12.

In even more detail, closing element 14 is at least once controllable from an active position (see FIGS. 2, 3, 4 and 6) in which closing element 14 is configured to interrupt a fluidic connection between pouring outlet 12 and inlet opening 18 and an inactive position (see FIG. 5) in which closing element 14 is configured to allow for a fluidic connection between pouring outlet 12 and inlet opening 18. Preferentially, closing element 14 is repeatedly controllable between the active position and the inactive position.

In particular, an initial configuration of spout 4 is such that closing element 14 is arranged in the active position. Even more particular, package 1 is distributed to an end consumer with spout 4 being in the initial configuration.

According to some preferred non-limiting embodiments, the first time lid 5 is attached on spout 4, spout 4 is in the initial configuration.

According to some preferred non-limiting embodiments, closing element 14 is connected, in particular fused, to the separation membrane. In particular, during control of closing element 14 between the active position and the inactive position also separation membrane changes its position.

According to some non-limiting alternative embodiments, closing element 14 defines partially or fully the separation membrane.

According to a preferred non-limiting embodiment, closing element 14 and collar 13 are molded in a single piece.

According to some preferred non-limiting embodiments, lid 5 is controllable between at least:

- a closing configuration, in which lid 5 is configured to cover and/or covers pouring outlet 12, in particular for impeding an outflow of the pourable product out of pouring outlet 12; and
- an open configuration in which lid 5 is configured to be and/or is detached from pouring outlet 12, in particular for allowing an outflow of the pourable product through pouring outlet 12.

According to some preferred non-limiting embodiments, lid 5 comprises a top wall 25 configured to cover pouring outlet 12 with lid 5 being controlled in the closing configuration and a side wall 26 protruding from top wall 25 and being configured to at least partially surround collar 13 with lid 5 being arranged in the closing configuration.

Preferentially, top wall 25 and side wall 26 delimit an internal space having a (substantially) cylindrical shape. In particular, the internal space houses, with lid 5 being arranged in the closing configuration, at least a portion of collar 13 and flow channel 20.

Preferentially, coupling members 16 are connected to top wall 25, in particular an inner surface of top wall 25, the inner surface of top wall 25 facing the internal space.

Please note that FIGS. 2 to 6 do not show lid 5. In particular, during formation of package 1, lid 5 is applied onto spout 4 with spout 4 being already coupled to main body 2. Preferentially, once lid 5 has been coupled to spout 4 and coupling members 16, lid 5 and coupling members 16 are always connected to one another in order to guarantee a permanent coupling of lid 5 and closing element 14.

Advantageously, lid-spout assembly 3 also comprises a coupling ring 27 configured to be arranged and/or being arranged around at least a portion of spout 4, in particular around at least a portion of collar 13, in particular such that coupling ring 27 is inseparable from spout 4, in particular from collar 13.

Preferentially, lid-spout assembly 3 also comprises rupturable coupling bridges connecting coupling ring 27 and lid 5 with one another. The coupling bridges are designed to irreversibly rupture during the first control of lid 5 from the closing configuration to the open configuration.

Preferentially, lid 5 is hinged to coupling ring 27 and is adapted to angularly move around a hinge axis. In particular, the hinge axis being transversal, in particular perpendicular, to central axis E and/or longitudinal axis A.

Preferentially, lid 5 is movable between at least a first angular position and a second angular position around the hinge axis at which lid 5 is controlled in respectively the closing configuration and the open configuration.

Preferentially, lid 5 and closing element 14 are coupled such that closing element 14 is in the active position and in the inactive position with lid 5 being respectively in the closing configuration and in the open configuration.

In particular, closing element 14 is in a respective first angular position (see FIGS. 2, 3 and 4) and in a respective second angular position (see FIG. 5) with respect to the hinge axis when being respectively in the active position and in the inactive position and is configured to angularly move around the hinge axis between the first angular position and the second angular position.

It should be noted that package 1, immediately after its formation, is in an initial configuration in which lid 5 and closing element 14 are respectively in the closing configuration and in the active position. Package 1 is distributed and/or sold to a user while being in the initial configuration.

Figure 3:
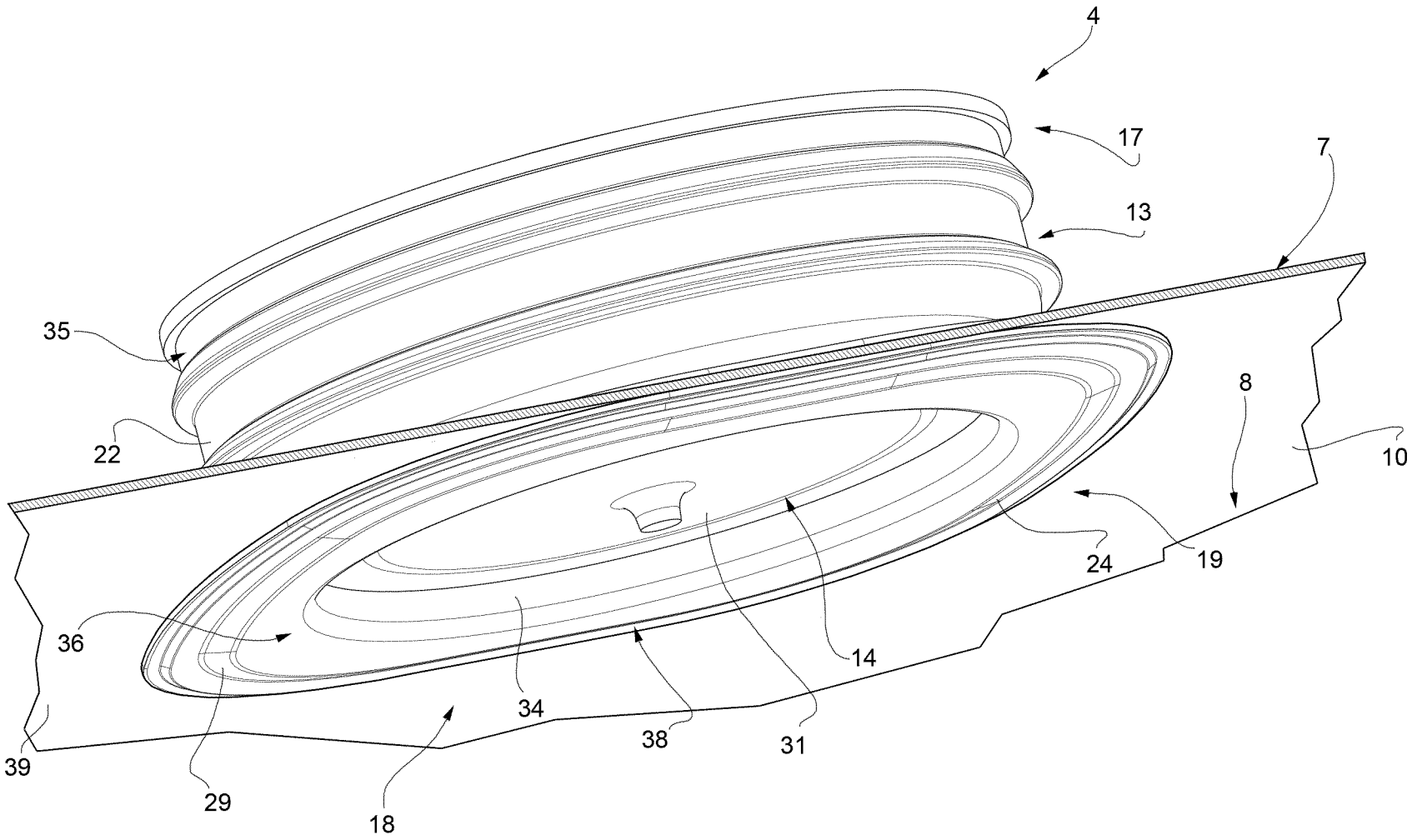
FIG. 3 is an enlarged perspective view of a detail of the spout of FIG. 1, with parts removed for clarity.
Figure 4:
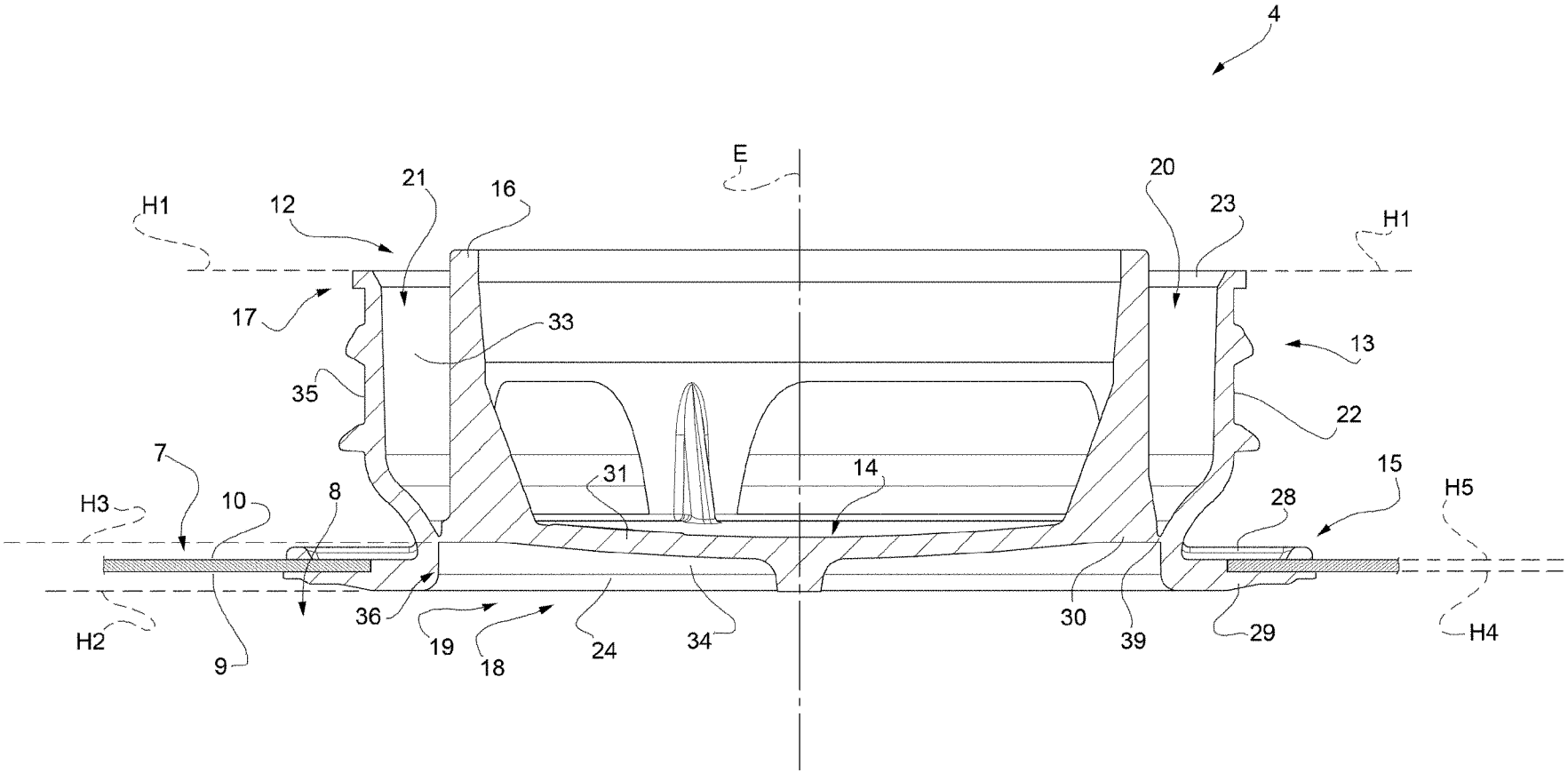
FIGS. 4 and 5 are sectionized views of some portions of the spout of FIG. 1 being in different configurations, with parts removed for clarity.
Figure 5:
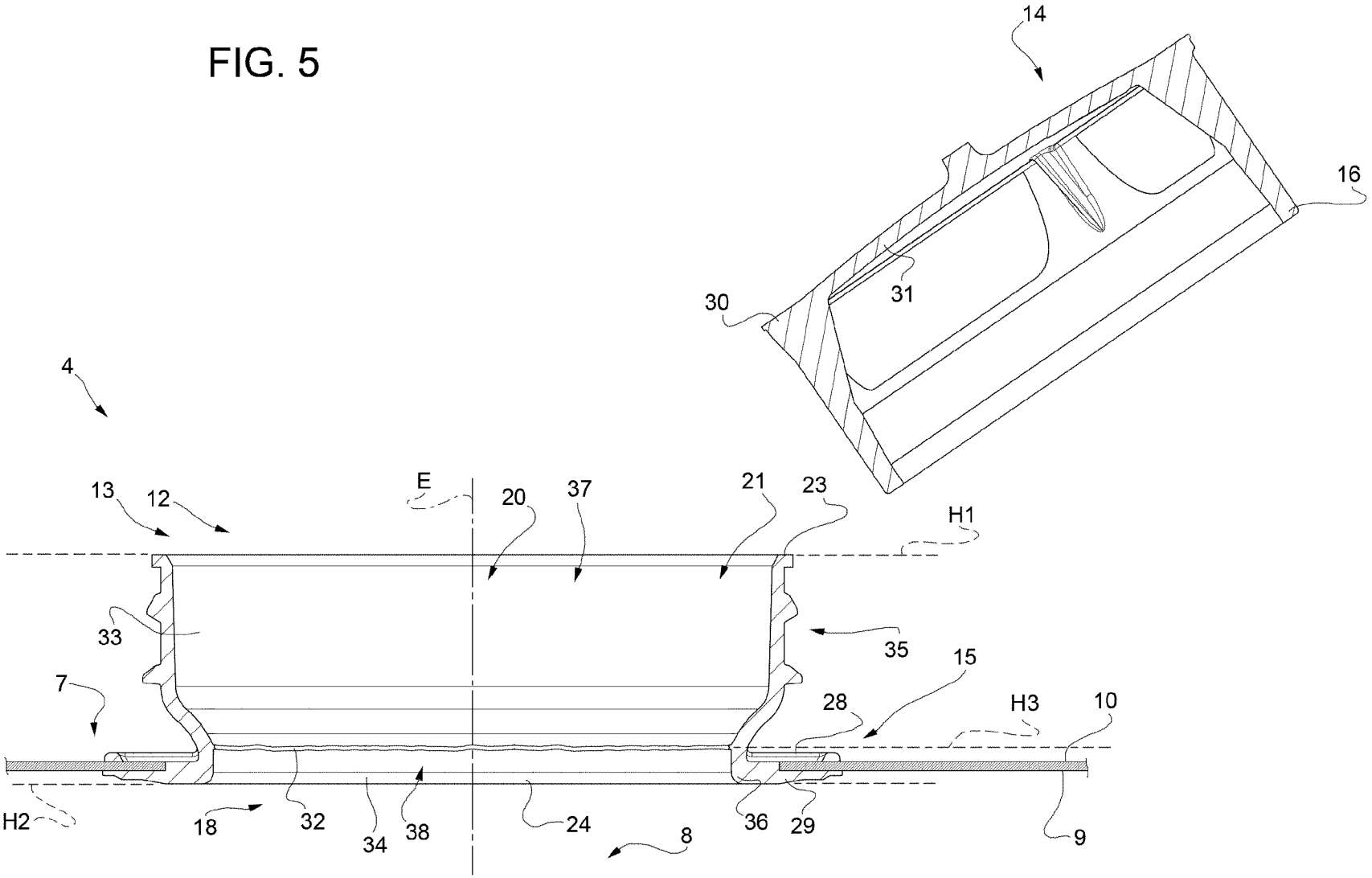

With particular reference to FIGS. 3, 4 and 5, base frame 15 comprises a first annular portion 28 and a second annular portion 29 axially displaced from one another with respect to central axis E and configured to interpose and/or interposing a portion of main body 2, in particular second wall portion 7, between one another. In particular, the portion of main body 2, in particular second wall portion 7, is at the designated pour outlet.

Preferentially, first annular portion 28 comprises a first engagement surface configured to contact outer surface 10 and second annular portion 29 comprises a second engagement surface configured to contact inner surface 9. In particular, the first engagement surface and the second engagement surface face one another.

Advantageously and with particular reference to FIGS. 2 to 5, closing element 14 is interposed between pouring outlet 12 and inlet opening 18 and is rupturably fixed to inner surface 21. In particular, closing element 14 is rupturably fixed to inner surface 21 with spout 4 being in the initial configuration. In other words, before closing element 14 is moved from the active position to the inactive position for the first time, closing element 14 is rupturably fixed to inner surface 21.

According to some preferred non-limiting embodiments, closing element 14 is configured to be repeatedly controlled between the active position and the inactive position. In particular, each time closing element 14 is controlled in the active position, closing element 14 is interposed between pouring outlet 12 and inlet opening 18.

In particular, closing element 14 is axially displaced (with respect to central axis E) from pouring outlet 12 and inlet opening 18, in particular when being in the active position. In other words, closing element 14 is axially displaced (with respect to central axis E) from first rim 23 and second rim 24.

According to some preferred non-limiting embodiments, closing element 14 is axially displaced (with respect to central axis E) from second annular portion 29, in particular from the second engagement surface, with closing element 14 being in the active position. Preferentially, closing element 14 is axially positioned such to not be interposed between first annular portion 28, in particular the first engagement surface, and second annular portion 29, in particular the second engagement surface.

According to some preferred non-limiting embodiments, closing element 14 comprises at least a peripheral portion 30, in particular having an annular shape and, contacting and/or being configured to contact inner surface 21 at a respective contact portion of inner surface 21 and with closing element 14 being in the active position.

Preferentially, closing element 14 also comprises a central wall 31 connected to and extending, in particular radially extending, from peripheral portion 30, in particular towards a center of closing element 14.

In particular, closing element 14 is integral and/or continuous meaning that closing element 14, in particular peripheral portion 30 and central wall 31, do(es) not comprise any passages and/or through-holes.

According to the preferred non-limiting embodiment shown, central wall 31 is convex with respect to first plane H1 and with closing element 14 being in the active position.

Preferentially, central wall 31 is curved towards inlet opening 18 and/or second rim 24 with spout 4 being in the initial configuration. In particular, central wall 31 is curved such that a center point of central wall is arranged closer to inlet opening 18 and/or second rim 24 than peripheral portion 30 with respect to central axis E and with spout 4 being in the initial configuration.

Alternatively, central wall 31 is curved towards pouring outlet 12 and/or first rim 23 with spout 4 being in the initial configuration. In particular according to such an alternative, central wall 31 is curved such that the center point of central wall is arranged closer to pouring outlet 12 and/or first rim 23 than peripheral portion 30 with respect to central axis E and with spout 4 being in the initial configuration.

Advantageously, prior to a first control of closing element 14 from the active position to the inactive position (i.e. while spout 4 is in the initial configuration) peripheral portion 30 contacts and is rupturably fixed to inner surface 21 along an initial contact portion 32, in particular having an annular shape, of inner surface 21.

In particular, by peripheral portion 30 being in contact with inner surface 21 a sealing effect at the interface of peripheral portion 30 and inner surface 21 is achieved.

According to some non-limiting embodiments, initial contact portion 32 is arranged such that inner surface 21 comprises:

- a main surface portion 33 extending from initial contact portion 32 towards (and to) pouring outlet 12 and/or first rim 23; and
- an auxiliary surface portion 34 extending from initial contact portion 32 towards and to inlet opening 18 and/or second rim 24.

In particular, initial contact portion 32 is axially displaced (with respect to central axis E) from inlet opening 18 and/or second rim 24 and towards pouring outlet 12 and/or first rim 23.

Preferentially, initial contact portion 32 is also axially displaced with respect to central axis E from second annular portion 29 and towards pouring outlet 12 and/or first rim 23.

Preferentially, initial contact portion 32 lies within a third plane H3, in particular distinct from and parallel to first plane H1 and second plane H2. In particular, third plane H3 is perpendicular to central axis E.

In particular, third plane H3 is interposed between first plane H1 and second plane H2.

According to some preferred non-limiting embodiments, an axial distance (with respect to central axis E) between second plane H2 and third plane H3 is larger than a thickness of peripheral portion 30. In particular, the axial distance is at least twice, preferentially at least three times, even more particular at least four times the thickness of peripheral portion 30.

According to some preferred non-limiting embodiments, collar 13 comprises a main portion 35 having main surface portion 33 and an auxiliary portion 36, in particular being ring-shaped and, having auxiliary surface portion 34.

Preferentially, main surface portion 33 and auxiliary surface portion 34 define and/or delimit respectively a main space 37 and an auxiliary space 38 of flow channel 20.

In particular, closing element 14 is configured to impede any pourable product to enter main space 37 when being arranged in the active position.

In particular, auxiliary space 38 has a cylindrical shape.

Preferentially, main space 37 has a portion having a frustoconical shape, in particular the portion tapering towards inlet opening 18 and/or second rim 24.

According to some preferred non-limiting embodiments, auxiliary surface portion 34 is transversal to main surface portion 33. In particular, auxiliary surface portion 34 is parallel to central axis E and main surface portion 33 is transversal to central axis E.

Preferentially, a first slope of auxiliary surface portion 34 and a second slope of main surface portion 33 are such that initial contact portion 32 defines a plurality of inflection points. In particular, the first slope and the second slope are defined with respect to an intersection plane comprising longitudinal axis E (i.e. longitudinal axis E lies on the intersection plane and longitudinal axis E and the interaction plane are parallel to one another). This intersection plane intersects with inner surface 21 obtaining a one-dimensional curve (in particular two one-dimensional curves as the intersection plane intersects with two different portions of inner surface 21). Each one-dimensional curve comprises a first portion and a second portion lying on respectively auxiliary surface portion 34 and main surface portion 33. A respective intersection point between the first portion and the second portion corresponds to a respective point of initial contact portion 32. Preferentially, each intersection point is an inflection point of the respective one-dimensional curve.

According to some preferred non-limiting embodiments, inner surface 9 and outer surface 10 are arranged, in particular at the designated pour outlet, within respectively a fourth plane H4 and a fifth plane H5, in particular transversal, even more particular perpendicular, to central axis E.

Preferentially, third plane H3 is axially distanced from fifth plane H5.

Preferentially, third plane H3 coincides with fifth plane H5 or is axially displaced from fifth plane H5 with respect to central axis E and towards pouring outlet 12.

According to some preferred non-limiting embodiments, spout 4, in particular closing element 14, even more particular peripheral portion 30, further comprises a coupling membrane 39 rupturably fixing closing element 14 to inner surface 21, in particular with spout 4 being in the initial configuration or in other words prior to the first control of closing element 14 from the active position to the inactive position. In particular, coupling membrane 39 guarantees sealing of inner space 8 prior to the first control of closing element 14 from the active position to the inactive position.

Preferentially, coupling membrane 39 is configured to irreversibly rupture (see FIGS. 4 to 6) during a first removal of closing element 14 from inner surface 21, in particular during the first control of closing element 14 from the active position to the inactive position. This means that after the rupture of coupling membrane 39, closing element 21 remains in contact with inner surface 21, while not being fixed to inner surface 21 anymore. This guarantees the interruption of the fluidic connection between inlet opening 18 and pouring outlet 12 (see FIG. 6) each time closing element 14 is arranged again within flow channel 20, in particular each time closing element 14 is arranged again in the active position.

In use, a user receives package 1 with lid 5 and closing element 14 being respectively in the closing configuration and the active position so as to respectively cover pouring outlet 12 and to impede any fluidic connection between inlet opening 18 and pouring outlet 12.

Prior to the first control of lid 5 from the closing configuration to the open configuration and of closing element 14 from the active position to the inactive position, peripheral portion 30 contacts initial contact portion 32. In particular, the sealing effect obtained is (initially) guaranteed by coupling membrane 39.

The user, in order to access the pourable product, needs to control lid 5 from the closing configuration to the open configuration leading to a control of closing element 14 from the active position to the inactive position allowing the pourable product to flow from inner space 8 through inlet opening 18 into flow channel 20 and out of flow channel 20 through pouring outlet 12.

When closing element 14 moves from the active position to the inactive position for the first time, coupling membrane 39 irreversibly ruptures.

Lid 5 and closing element 14 can be reversibly controlled in respectively the closing configuration and the open configuration and the active position and inactive position so as to selectively control whether to impede or allow the outpouring of the pourable product.

Each time closing element 14 is arranged again in the active position, closing element 14 remains arranged between pouring outlet 12 and inlet opening 18. In particular, peripheral portion 30 contacts the contact portion of inner surface 21. The contact portion can correspond to initial contact portion 32 but can also deviate therefrom.

In particular, closing element 14 interrupts the fluidic connection between inlet opening 18 and pouring outlet 12, with closing element 14 being in the active position.

Figure 6:
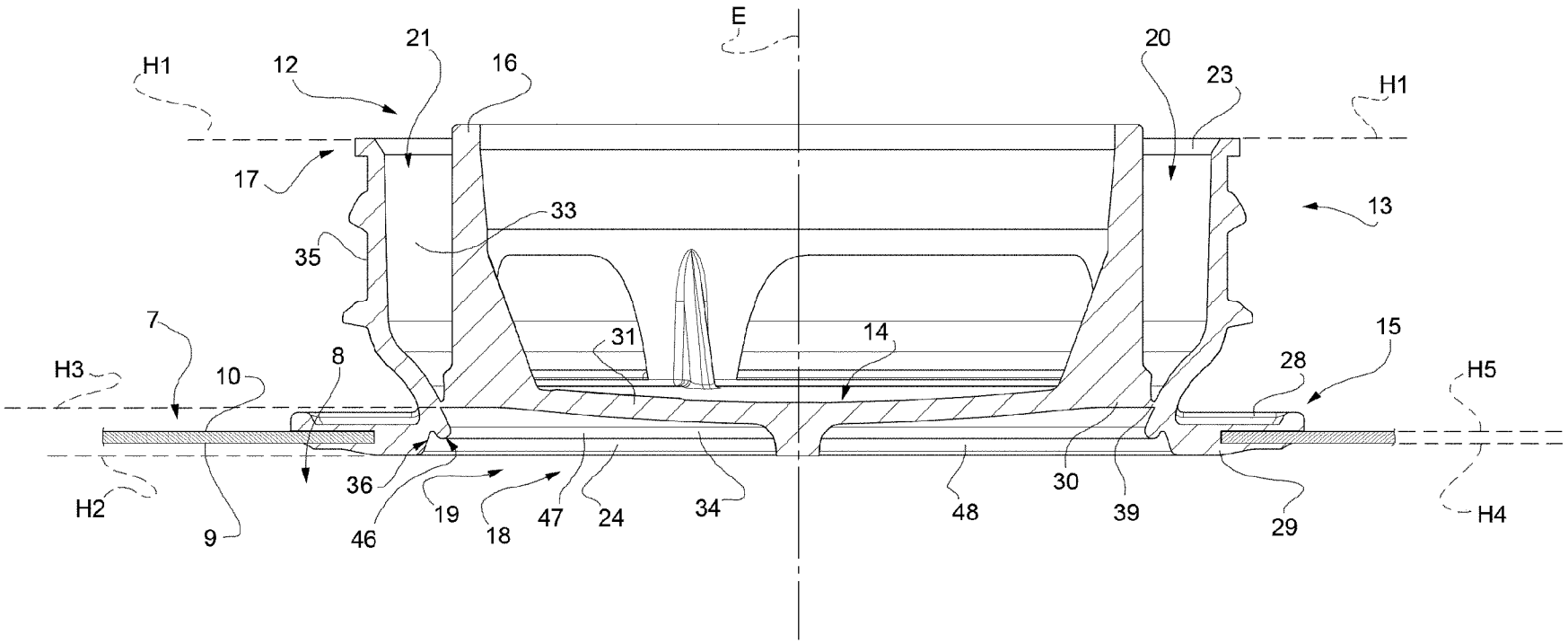
FIG. 6 is a sectionized view of some details of a spout according to a second embodiment of the present invention, with parts removed for clarity.

With reference to FIG. 6, number 4' indicates an alternative embodiment of a spout of lid-spout assembly 3 according to the present invention; as spout 4' is similar to spout 4, the following description is limited to the differences between them, and using the same references, where possible, for identical or corresponding parts.

In particular, spout 4' differs from spout 4 in that auxiliary portion 36 comprises at least an annular lid 46 connected to main portion 35 and protruding from main portion 35 and towards inlet opening 18. Preferentially, annular lid 46 delimits a portion of auxiliary space 38, in particular having a frustoconical shape. Preferentially, the portion of auxiliary space 38 tapers towards inlet opening 18 and/or second rim 24. In particular, this also means that auxiliary space 38 does not have a cylindrical shape as in the case of spout 4.

In particular, auxiliary surface portion 34 is transversal to central axis E.

Preferentially, a terminal edge 47 of annular lid 46 is interposed between inlet opening 18 and initial contact portion 32 (in other words, terminal edge 47 is interposed between second plane H2 and third plane H3.

According to some preferred non-limiting embodiments, auxiliary portion 36 also comprises an end section 48 connected to annular lid 46 and carrying second rim 24. In particular, end section 48 delimits a further portion of auxiliary space 38, in particular also having a frustoconical shape. In particular, the further portion of auxiliary space 38 tapers from inlet opening 18 towards initial contact portion 32.

Preferentially, a minimum diameter of end section 48 is larger than a diameter of annular lid 46 at terminal edge 4.

As the operation of package 1 having spout 4' is similar to the one of package 1 having spout 4, we refer to the above-provided description.

Figure 7:
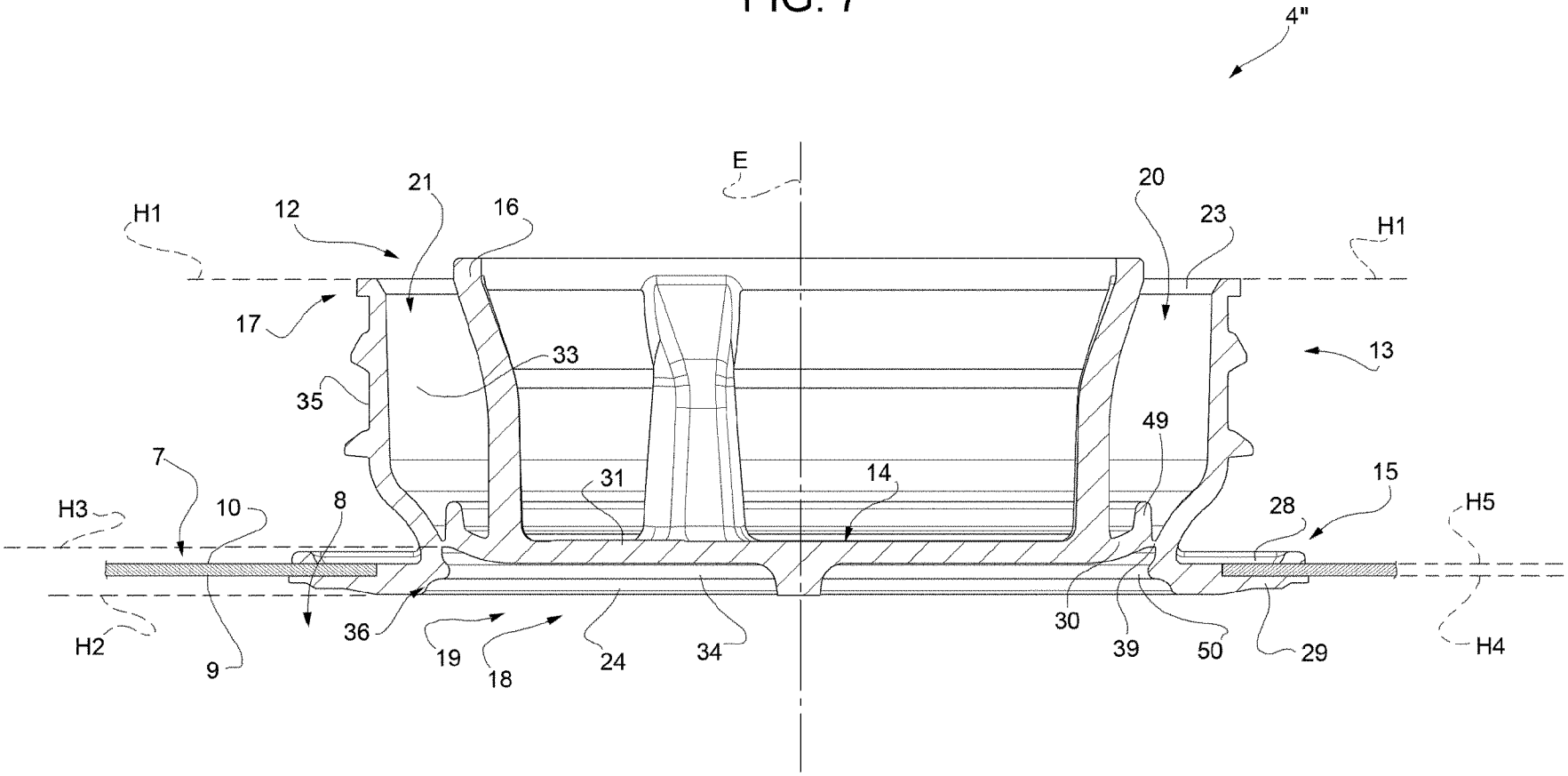
FIG. 7 is a sectionized view of some details of a spout according to a third embodiment of the present invention, with parts removed for clarity.

With reference to FIG. 7, number 4" indicates an alternative embodiment of a spout of lid-spout assembly 3 according to the present invention; as spout 4" is similar to spout 4, the following description is limited to the differences between them, and using the same references, where possible, for identical or corresponding parts.

In particular, spout 4" differs from spout 4 in that closing element 14 further comprises a contact ring 49 connected to and protruding from peripheral portion 30. Advantageously, contact ring 49 is configured to contact inner surface 21, in particular in order to increase a sealing surface between closing element 14 and inner surface 21 with lid 5 being in the active position.

According to some preferred non-limiting embodiments, contact ring 49 extends from peripheral portion 30 and towards top wall 25.

In particular, spout 4" also differs from spout 4 in that auxiliary portion 36 also comprises an annular restriction lip 50 arranged between initial contact portion 32 and inlet opening 18. In particular, annular restriction lip 50 protrudes towards a center of auxiliary portion 36.

Preferentially, a diameter of annular restriction lid 50 is smaller than a diameter of auxiliary portion 36 at second rim 24.

As the operation of package 1 having spout 4" is similar to the one of package 1 having spout 4, we refer to the above-provided description.

The advantages of spout 4, spout 4', spout 4" and/or of lid-spout assembly 3 and/or of package 1 according to the present invention will be clear from the foregoing description.

In particular, by arranging closing element 14 within flow channel 20 and between pouring outlet 12 and inlet opening 18 (i.e. with closing element 14 being moved away from second rim 24 and towards pouring outlet 12 with respect to the solutions known in the state-of-the art) one obtains a spout 4 or a spout 4' or a spout 4", which comes along with an increased stability. Thus, lid-spout assembly 3 is more stable during the formation of package 1 within an automatic machine.

A further advantage resides in arranging main surface portion 33 and auxiliary surface portion 34 transversal to one another, it is possible to obtain a more precise cut and/or break of the separation membrane and/or of closing element 14 and/or it is possible to improve controlling of base frame 15.

An even other advantage is seen in that the axial distance between closing element 14 and top wall 25 is smaller, meaning that coupling members 16 are shorter with respect to the solutions known in the art. This also means that individual coupling members 16 are less deformable, so increasing the stability of closing element 14.

A further advantage is seen in that, due to the short coupling members 16, the quantity of polymers needed for the formation of spout 4 or spout 4' or spout 4" is reduced.

An even other advantages resides in that the sealing effect of closing element 14 is improved as closing element 14 contacts inner surface 21 even in the case of positional deformations of closing element 14, which would lead, in the solutions known in the art, to the formation of a fluidic connection between inner space 8 and pouring outlet 12.

Clearly, changes may be made to spout 4, spout 4', spout 4" and/or lid-spout assembly 3 and/or package 1 as described herein without, however, departing from the scope of protection as defined in the accompanying claims.

According to an alternative embodiment not shown, control of lid 5 between the closing configuration and the open configuration and accordingly of closing element 14 between the active position and the inactive position is achieved by means of a screwing action on lid 5.

According to an alternative embodiment not shown, spout 4 or spout 4' could comprise contact ring 49.

According to an alternative embodiment not shown, spout 4 or spout 4' could comprise restriction ring 50.

The invention claimed is:

1. Lid-spout assembly for a package having a designated pour opening and being filled with a pourable product, the lid-spout assembly comprising a spout, a coupling ring coupled to the spout, and a lid hinged to the coupling ring so as to be angularly movable relative to the coupling ring to selectively open and close a pouring outlet of the spout;

wherein the spout comprises at least:

a collar extending along a longitudinal axis, carrying a pouring outlet at a first axial end and an inlet opening for the pourable product at a second axial end and delimiting a flow channel for the pourable product extending between the pouring outlet and the inlet opening, wherein the collar has an inner face delimiting the flow channel and an outer face opposite to the inner face; and a closing element configured to interrupt a fluidic connection between the pouring outlet and the inlet opening, wherein the closing element is interposed between the inlet opening and the pouring outlet and is rupturably fixed to an inner surface of the collar, wherein the lid is controllable, without rotating the lid about the longitudinal axis, between at least a closing configuration in which the lid covers the pouring outlet and an open configuration in which the lid is detached from the pouring outlet, wherein the lid and the closing element are coupled such that the closing element is in an active position and in an inactive position with the lid being respectively in the closing configuration and in the open configuration, wherein the spout comprises a base frame configured to couple the spout to a main body of the package and carrying the collar, wherein the base frame comprises a first annular portion and a second annular portion, the first annular portion and the second annular portion extending perpendicularly to the longitudinal axis and radially protruding in the same direction from the outer face of the collar, wherein the first annular portion and the second annular portion are axially displaced from one another for interposing a portion of the main body between one another, wherein the first annular portion is configured to contact an outer surface of the main body and the second annular portion is configured to contact an inner surface of the main body, wherein the closing element is at least axially displaced above the second annular portion, with respect to the longitudinal axis.

2. Lid-spout according to claim 1, wherein the closing element is controllable between an active position in which the closing element is configured to interrupt the fluidic connection between the pouring outlet and the inlet opening and an inactive position in which the closing element is configured to allow for a fluidic connection between the pouring outlet and the inlet opening;

wherein prior to the first time the closing element is controlled from the active position to the inactive position the closing element is rupturably fixed to the inner surface.

3. Lid-spout according to claim 1, wherein the collar extends along a central axis and comprises a first rim arranged at the first axial end and delimiting the pouring outlet and a second rim arranged at the second axial end and delimiting the inlet opening;

wherein the closing element is axially displaced from the first rim and the second rim.

4. Lid-spout assembly according to claim 1, wherein the first annular portion comprises a first engagement surface configured to contact the outer surface of the main body and the second annular portion comprises a second engagement surface configured to contact the inner surface of the main body;

wherein the closing element is at least axially displaced from the second engagement surface.

5. Lid-spout assembly according to claim 1, wherein the closing element comprises a peripheral portion rupturably fixed to the inner surface along an initial contact portion of the inner surface;

wherein the inner surface comprises:

a main surface portion extending from the initial contact portion towards the pouring outlet; and an auxiliary surface portion extending from the initial contact portion to the inlet opening.

6. Lid-spout assembly according to claim 5, wherein the initial contact portion is axially displaced from the inlet opening and towards the pouring outlet.

7. Lid-spout assembly according to claim 5, wherein the initial contact portion is annularly shaped.

8. Lid-spout assembly according to claim 5, wherein the auxiliary surface portion defines and/or delimits an auxiliary space having a frustoconical shape or a cylindrical shape.

9. Lid-spout assembly according to claim 5, wherein the pouring outlet extends within a first plane, the inlet opening extends within a second plane distinct from the first plane and the initial contact portion extends within a third plane distinct from the first plane and the second plane; wherein the third plane is interposed between the first plane and the second plane.

10. Lid-spout assembly according to claim 1, wherein the closing element comprises a coupling membrane rupturably fixing the closing element to the inner surface;

wherein the coupling membrane is configured to irreversibly rupture during a first removal of the closing element from the inner surface.

11. Package filled with a pourable product and comprising at least one lid-spout assembly according to claim 1.

12. Lid-spout assembly according to claim 1, further comprising rupturable coupling bridges connecting the coupling ring and the lid with one another, wherein the coupling bridges are designed to irreversibly rupture during first control of the lid from the closing configuration to the open configuration.

13. Lid-spout assembly for a package having a designated pour opening and being filled with a pourable product, the lid-spout assembly comprising a spout and a lid coupled to the spout and configured to selectively open and close a pouring outlet of the spout, wherein the spout comprises at least:

a collar extending a long a longitudinal axis, carrying the pouring outlet at a first axial end and an inlet opening for the pourable product at a second axial end and delimiting a flow channel for the pourable product extending between the pouring outlet and the inlet opening, wherein the collar has an inner face delimiting the flow channel and an outer face opposite to the inner face; and a closing element configured to interrupt a fluidic connection between the pouring outlet and the inlet opening, wherein the closing element is interposed between the inlet opening and the pouring outlet and is rupturably fixed to an inner surface of the collar, wherein the lid is controllable between at least a closing configuration in which the lid covers the pouring outlet and an open configuration in which the lid is detached from the pouring outlet, wherein the closing element is controllable between an active position in which the closing element is configured to interrupt the fluidic connection between the pouring outlet and the inlet opening and an inactive position in which the closing element is configured to allow for a fluidic connection between the pouring outlet and the inlet opening;

wherein, prior to and after the first time the closing element is controlled from the active position to the inactive position, the lid and the closing element are coupled such that the closing element is in the active position and in the inactive position with the lid being respectively in the closing configuration and in the open configuration, wherein the base frame comprises a first annular portion and a second annular portion, the first annular portion and the second annular portion extending perpendicularly to the longitudinal axis and radially protruding in the same direction from the outer face of the collar, wherein the first annular portion and the second annular portion are axially displaced from one another for the interposing a portion of the main body between one another, wherein the first annular portion is configured to contact an outer surface of the main body and the second annular portion is configured to contact an inner surface of the main body, wherein the closing element is at least axially displaced above the second annular portion, with respect to the longitudinal axis.

14. Lid-spout assembly according to claim 13, wherein the lid is not configured to seal against the inner surface of the collar.

* * * * *